United States Patent [19]

Osthoff et al.

[11] Patent Number: 4,641,403

[45] Date of Patent: Feb. 10, 1987

[54] MACHINE FOR FLAME PROCESSING OF TEXTILE FABRIC WEBS

[75] Inventors: Walter Osthoff; Otmar Hohenester, both of Wuppertal; Anton Gessner, Remscheid, all of Fed. Rep. of Germany

[73] Assignee: Osthoff Senge GmbH & Co. KG, Wuppertal, Fed. Rep. of Germany

[21] Appl. No.: 740,047

[22] PCT Filed: Sep. 29, 1984

[86] PCT No.: PCT/DE84/00199

§ 371 Date: May 29, 1985

§ 102(e) Date: May 29, 1985

[87] PCT Pub. No.: WO85/01530

PCT Pub. Date: Apr. 11, 1985

[30] Foreign Application Priority Data

Sep. 29, 1983 [DE] Fed. Rep. of Germany ..... 3335304

[51] Int. Cl.[4] ..... D06C 9/02

[52] U.S. Cl. ..... 26/3; 431/158

[58] Field of Search ..... 26/3; 239/451, 455; 431/158; 28/174

[56] References Cited

U.S. PATENT DOCUMENTS

| | | | |
|---|---|---|---|
| 602,813 | 4/1898 | Binder | 26/3 |
| 2,972,299 | 2/1961 | De Marchi | 239/451 X |
| 3,448,498 | 6/1969 | Sando et al. | 26/3 |

FOREIGN PATENT DOCUMENTS

| | | | |
|---|---|---|---|
| 550895 | 9/1956 | Belgium . | |
| 67445 | 3/1893 | Fed. Rep. of Germany | 26/3 |
| 21802 | 8/1961 | German Democratic Rep. | 26/3 |
| 60-29776 | 7/1985 | Japan | 26/3 |
| 358403 | 1/1962 | Switzerland . | |
| 557915 | 1/1975 | Switzerland . | |

OTHER PUBLICATIONS

Melliand Textilberichte, issue 11, Nov. 9, 1982, (Heidelberg, DE), "Problematik des Sengens von Textilen Flächengebilden aus Polyester und Polyester-Mischungen", pp. 794 to 797.

*Primary Examiner*—Robert R. Mackey

*Attorney, Agent, or Firm*—Antonelli, Terry & Wands

[57] ABSTRACT

A machine for flame processing textile fabric webs (27), especially a singeing machine, is equipped with a burner unit (35) which comprises a combustion chamber terminating in a singeing slit, connected to a gas mixing chamber by a mixture feed slot (7).

To save energy, the width of the working flame should be adjustable continuously and with low operating cost, whereby in particular provision should be made for automatically adjusting the flame width to the width of the fabric web (27) being processed. For this purpose, the burner unit (35) is provided with one or two flexible sealing strips (13) for the mixture feed slot, said strips being insertable from one or both ends of the burner unit, each of said strips further having its outer end wound on a winding body (33), rotatable for adjusting the inner ends of sealing strips (13).

13 Claims, 6 Drawing Figures

IV
II
I
1
2
7
10
11
13
14
15
16
17
18
19
20
21
22

MACHINE FOR FLAME PROCESSING OF TEXTILE FABRIC WEBS

BACKGROUND OF THE INVENTION

The invention relates to a machine for flame processing of textile fabric webs, especially a singeing machine with a burner unit comprising a combustion chamber terminating in a singeing slit, said chamber being connected with a gas mixing chamber via a gas feed slot, said slot being partially closeable by means of a damping device to adjust the flame width.

In machines of this type, textile fabric webs are carried past a singeing flame at high speed whereby this same machine is used to process fabric webs of very different widths. The maximum acceptable fabric web width depends on the width of the machine, which is usually several meters. Without suitable devices, a large portion of the singeing flame would burn uselessly during the processing of narrow fabric webs, i.e. high energy costs not required for the flame processing process would result.

A machine is known from German Pat. No. 20 23 782 in which the mixture feed slot to the conbustion chamber can be closed off by a row of strip shaped sealing elements in segments. The device described in that patent can achieve considerable energy savings; however when the sealing element is divided into segments it must generally be taken into account that a portion of the gas will continue to burn uselessly outside the width of the fabric web. In addition, adjustment of the flame width to a new fabric web is labor-intensive, for which reason there is a danger that the operating personnel, for reasons of convenience, will fail to adjust the singeing flame width.

The goal of the invention is to provide a machine wherein the width of the working flame can be adjusted continuously and with low operating expense.

This goal is achieved according to the invention by virtue of the fact that the damping device comprises one or two sealing strips insertable from one or both ends of the burner unit for the mixture feed slot. The important advantage of the end-wise insertion of sealing strips consists in the continuous adjustability of the flame width, so that a precise adjustment to the particular width of web being transported past the flame is possible. The pushing of sealing strips in and out from the ends of the burner unit is clearly simpler than, for example, operating a row of levers, as would be required with a discontinuous adjusting device.

As a result of the invention, the sealing strips can be guided in an expansion channel provided in the side walls of the mixture feed slot. To install a continuous damping device, therefore, a slight change in an already existing component is required without additional fastening devices or the like inside the burner unit being required. The invention can thus be achieved in a simple and cost-effective manner.

According to a preferred embodiment of the invention, the sealing strips can be flexible and wound by their outward end segments respectively upon rotatable winding bodies for adjusting the inward ends of the sealing strips, from which point the sealing strips are guided through guide tubes to the ends of the burner unit. When flexible sealing strips are used, in contrast to rigid rods or the like, the normal width of the machine can be retained. The guide tubes between the winding bodies and the ends of the burner unit can be guided in the same fashion as, for example, cooling tubes or pipes for the gas supply, so that the overall result is an extremely space-saving design. The continuous adjustment of the flame width can be accomplished by using a simple rotary motion.

According to another feature of the invention, the sealing strips can be made gas-permeable to an extent which is sufficient for feeding an igniting flame. This gas permeability of the sealing strips, which can be implemented by holes, slots, or the like, gives the operating personnel the opportunity to ignite the singeing flame from the ends of the burner unit safely even when the flame width is considerably reduced. The resultant gas losses remain extremely low and are insignificant cost-wise.

As a result of the invention, the sealing strips can consist of metal strips twisted into tubes. Tubes twisted in this fashion, so-called spiral tubes, are suitable for various reasons optimally for adjustment of the flame width: they can be made of heat-resistant metal and are still flexible. They can have a high tensile and compressive strength by suitable crimping of the edges of the strips lengthwise and have cross slots arranged regularly at close intervals, ensuring a specific gas permeability.

According to another embodiment of the invention, the machine can have associated with it a conveyor with two edge sensors scanning the edges of the belt, and can be provided with an adjusting device which shifts the sealing strip along the mixture feed slot as a function of the position of the edge sensor. The continuous adjusting device of the damping device according to the invention is especially suitable for automation whereby mechanical, pneumatic, or electrical drives and control devices may be used. The machiine need only be adjusted to the width of the fabric web on the fabric web guide, while the flame width is automatically changed at the same time. Since operating personnel are forced to operate the fabric web guide in any case for proper operation of the machine, optimum energy use will occur at all times.

As a result of the invention, the edge sensors can be adjusted by turning a spindle and the adjusting device can turn the winding bodies depending on the degree of spindle rotation. By using flexible sealing strips, especially spiral tubes, an adjusting device for adjusting the flame width can be produced in an especially simple fashion, because only two rotary motions, one on the fabric web guide and the other on the winding bodies, need be coordinated with each other.

According to a preferred embodiment of the invention, the spindle rotation can be detected by a set value potentiometer, the angular position of the winding bodies can be recorded by an actual value potentiometer, the values on the two potentiometers can be compared in an electronic regulator, and the winding bodies can be adjusted to conform to the preset value. This form of an electrical adjusting device has the advantage over mechanical control, for example, that it is extremely economical and takes up little space.

As a result of the invention, a pressure sensor can be located in the gas mixing chamber to detect an actual value and the machine can be equipped with a regulator which regulates the pressure in the gas mixing chamber to a presettable value by adjusting the gas mixture feed. The flame width and hence the throughput volume of the gas mixture is unavoidably linked with any change in the pressure in the gas mixing chamber, and is also therefore linked to the formation of the singeing flame. Without a regulator, therefore, any change in the width of the fabric web would involve a tedius adjustment of the singeing flame. The advantages of automatic adjustment of singeing flame width become most significant in practice when a suitable regulating device is used to keep a constant pressure in the gas mixing chamber. If such a device is present, however, the overall result is a machine with a high level of operating comfort and minimum energy consumption.

The invention is described in greater detail hereinbelow with reference to the drawings.

BRIEF DESCRIPTION OF THE DRAWINGS

FIG. 1 shows a singeing machine in a front elevation on a reduced scale.

FIG. 3 is the mixture feed slot of the burner unit shown in FIG. 2 with one sealing strip pushed in.

FIG. 4 is the mixture feed slot according to a view along IV in FIG. 3.

FIG. 5 shows the sealing strips with feeds from the singeing machine according to FIG. 1 looking in the same direction.

DETAILED DESCRIPTION

Figures 1, 3, 4, 5:
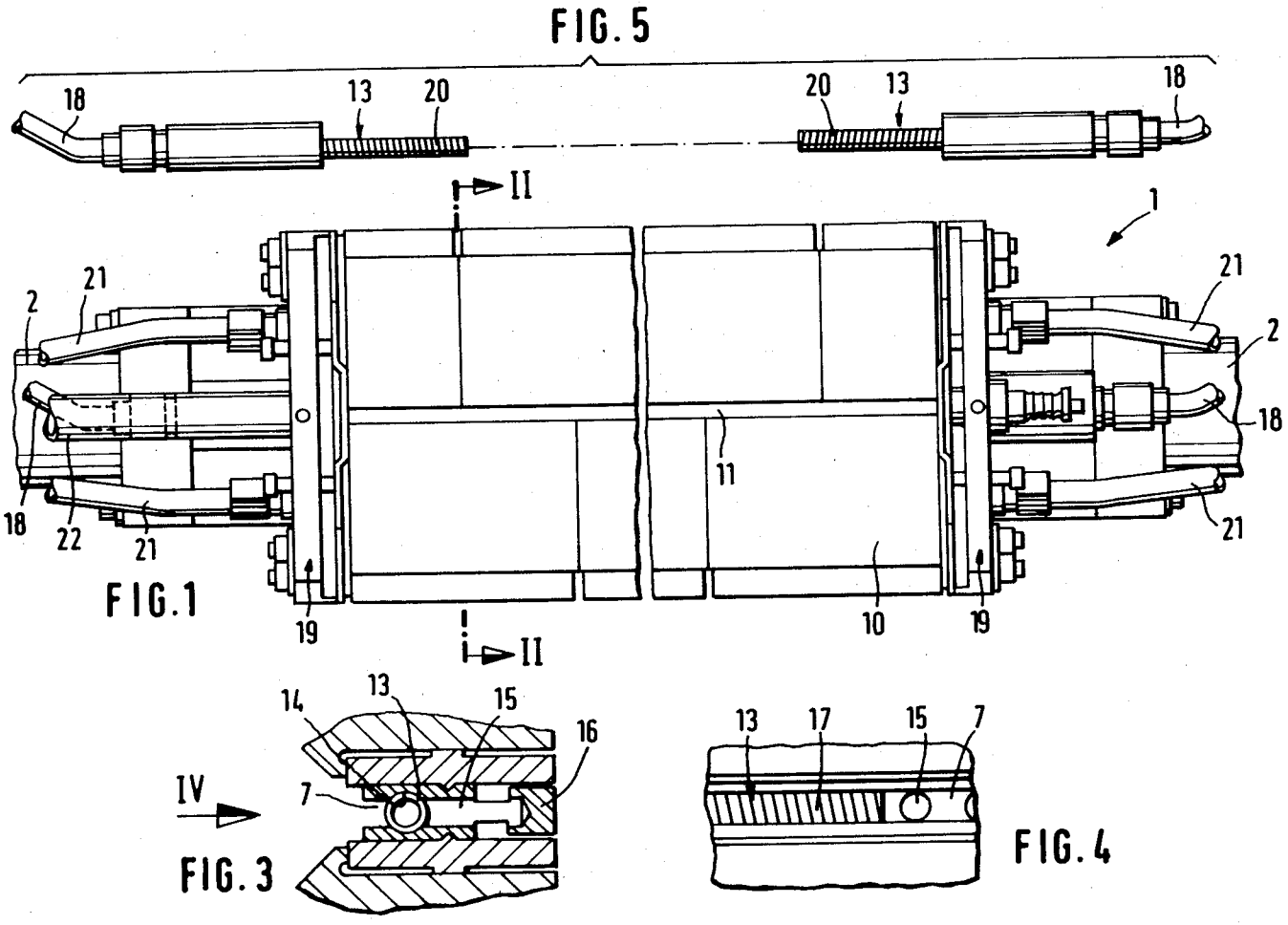
Figure 2:
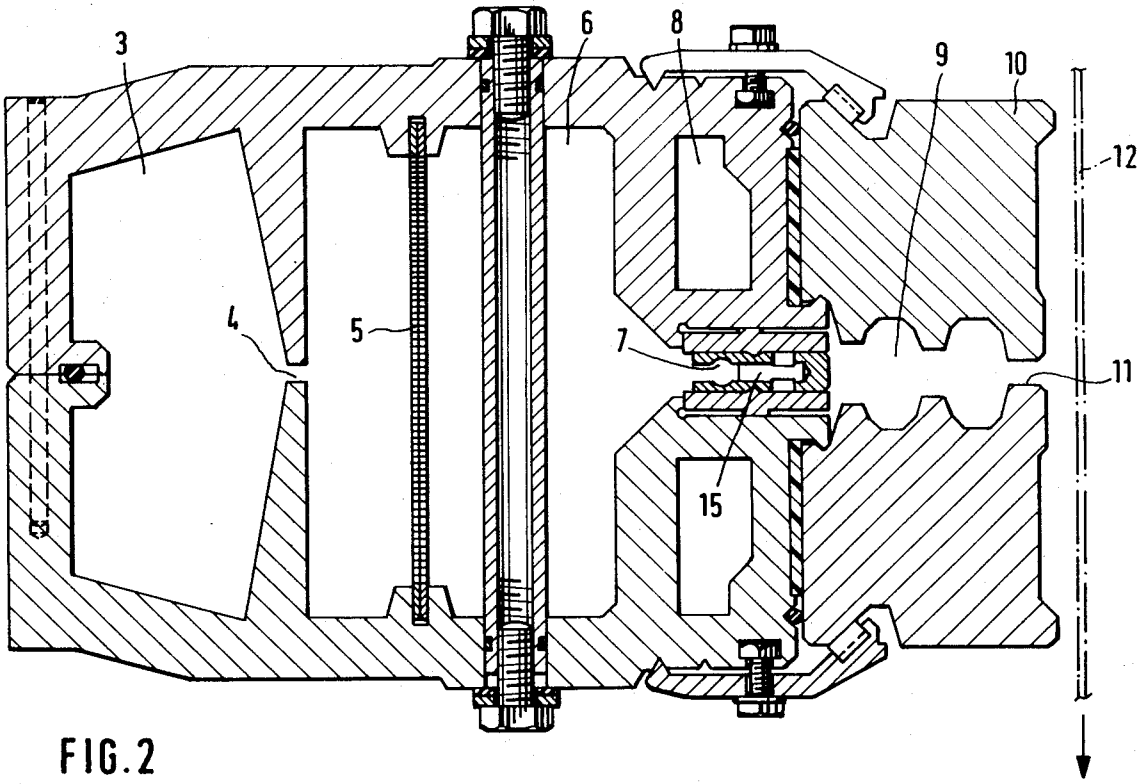
FIG. 2 is a section through the burner unit of the singeing machine along Section II—II in FIG. 1.

FIG. 1 shows a burner unit 1 of a singeing machine in a sharply shortened form, which has a total length of several meters only. Singeing machine 1 receives a gas mixture through feed tubes 2, said mixture initially flowing into a distributing chamber 3; see FIG. 2. The gas then passes through a stagnation stage 4 and a filter 5 and reaches a gas mixing chamber 6. The flow continues to travel from the gas mixing chamber through a mixture feed slot 7, kept at low temperature by cooling channels 8. The gas mixture burns in the adjoining combustion chamber 9, enclosed by "ramp stones" 10, enters through a singeing slot 11 in a highly heated state, and strikes a textile fabric web 12 which is being carried past singeing slot 11 at high speed.

FIG. 3 shows mixing feed slot 7 with a sealing strip 13 pushed in, said strip being guided in an expansion channel 14. Sealing strip 13 seals through-holes 15 in a mixture distributor strip 16.

FIG. 4 shows sealing strip 13, which closes off mixture feed slot 7 in the left-hand area and leaves through-holes 15 open in the right-hand area. Sealing strip 13 consists of a metal strip 17 twisted to form a tube.

Sealing strips 13 are guided via guide tubes 18 to ends 19 of burner unit 1; see FIG. 1.

FIG. 5 likewise shows guide tubes 18 separately as well as the inner ends 20 of sealing strips 13, which are slid inside mixing feed slot 7. Cooling tubes 21 as well as a flame monitoring tube 22 also run in ends 19 of burner unit 1.

Figure 6:
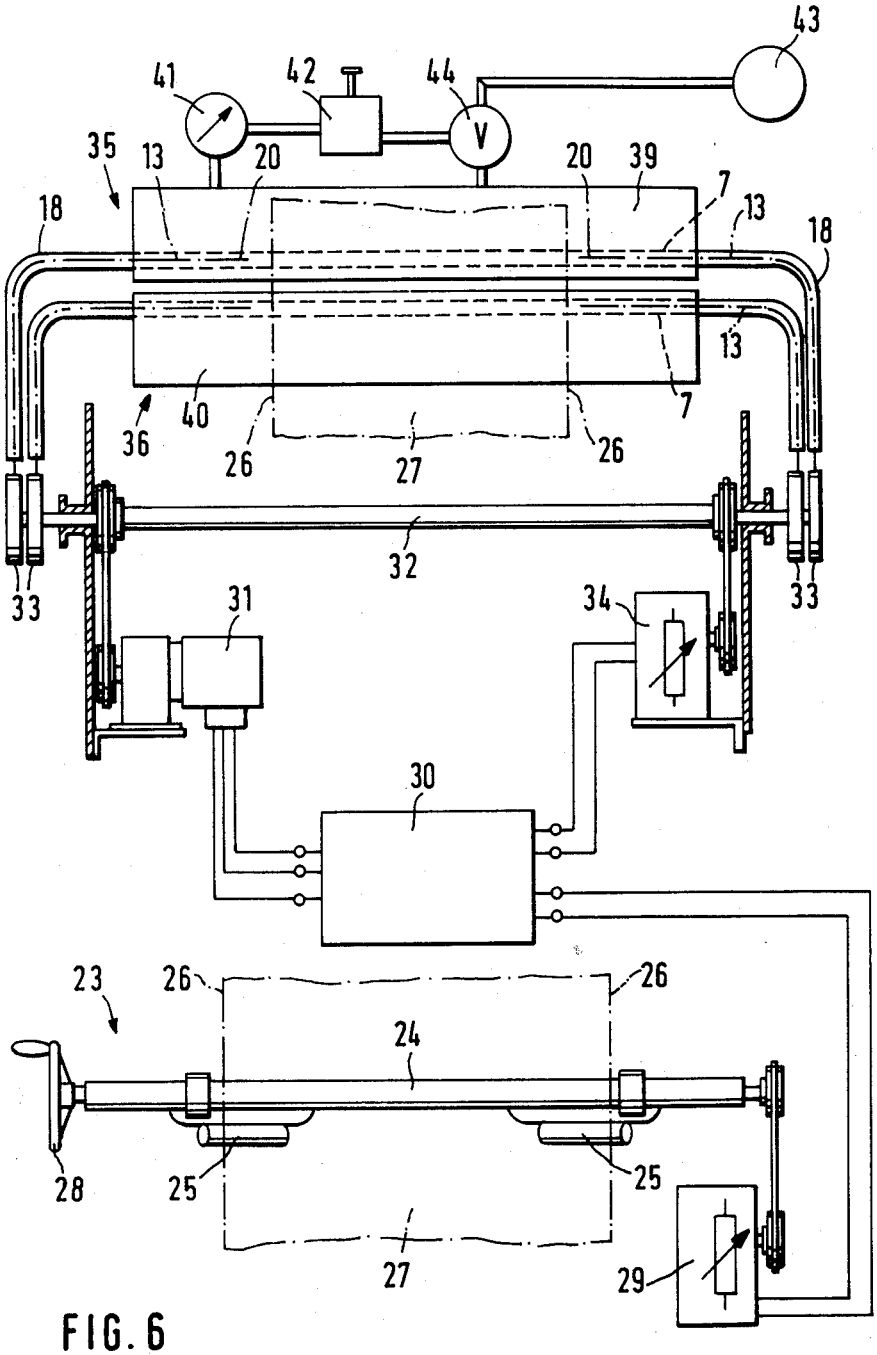
FIG. 6 is a hook-up diagram of a singeing machine with an autmatically adjusted damping device and pressure regulation of the gas mixing chamber.

FIG. 6 shows a web guide 23 comprising a spindle 24, on which two edge sensors 25 for the edges 26 (indicated by dot-dashed lines) of a fabric web 27 are disposed. The position of edge sensors 25 is adjusted by a handwheel 28 depending on the width of the fabric web 27, whereby the rotation of spindle 24 is detected by a set value potentiometer 29. Potentiometer 29 is connected with an electronic regulator 30 controlling an electric motor 31. Motor 31 in turn drives a shaft 32 with a suitable transmission ratio, on whose ends winding bodies 33 are mounted. The corresponding angular position of shaft 32 or winding bodies 33 is recorded by an actual value potentiometer 34 and compared in regulator 30 with a preset value on set value potentiometer 29. Regulator 30 can then use motor 31 to change the angular position of winding bodies 33 if required.

FIG. 6 shows a case in which a singeing machine is equipped with two burner units 35 and 36. Accordingly, two winding bodies 33 are provided on either side of shaft 32, on which the flexible sealing strips 13, shown dot-dashed, are wound. Sealing strips 13 are guided via guide tubes 18 as far as mixture feed slots 7, shown dashed. The free ends 20 of sealing strips 13 are adjusted in such fashion that the singeing flame is slightly wider than fabric web 27.

Mixture feed slots 7 are supplied with gas via gas mixture chambers 39 and 40. A pressure regulator is shown for upper gas mixing chamber 39. It consists of a pressure sensor 41 which determines the actual pressure in gas mixing chamber 39 and transmits it to a regulator 42. After comparing the actual pressure with a preset value, the gas mixture supply to gas mixing chamber 39 can be adjusted automatically through a regulating valve 44, prepared by a pressure source 43. Whenever spindle 24 is adjusted, not only the position of sealing strips 13 but also the pressure in gas mixing chamber 39 is adjusted.

We claim:

1. A singeing machine for flame processing of webs of textile goods comprising a burner means including a combustion chamber means opening into a singeing slot, a gas mixing chamber means connected to said combustion chamber means by a mixture feed slot means, damper means adjustable from ends thereof for at least partially sealing said mixture feed slot means to enable an adjustment of a flame width, said damper means including at least one flexible sealing strip means for said mixture feed slot means, said at least one flexible sealing strip means being insertable from at least one end of said burner means and being gas permeable to an extent sufficient to feed an ignition flame.

2. A singeing machine according to claim 1, wherein at least two flexible sealing strip means are provided.

3. A singeing machine according to claim 1, wherein said at least one flexible sealing strip means is insertable from both ends of the burner means.

4. A singeing machine according to claim 3, wherein at least two flexible sealing strip means are provided and are adapted to be inserted from both ends of the burner means.

5. A singeing machine according to one of claims 1, 2 or 3, wherein the sealing strip means are formed of metal strips rolled into tubes.

6. A singeing machine according to claim 5, further comprising a material web guide means including two edge sensor means for scanning edges of the web, and an adjusting means for shifting the sealing strip means along the mixture feed slot means in dependence upon a position sensed by the edge sensor means.

7. A singeing machine according to claim 6, further comprising spindle means for adjusting the edge sensor means, winding means for enabling a winding of outer ends of the flexible sealing strip means for adjustment of inner ends of the sealing strip means, said adjusting means being adapted to rotate the winding means as a function of an amount of spindle rotation, and wherein guide tube means are provided for guiding the sealing strip means to ends of the burner means.

8. A singeing machine according to claim 7, further comprising a set value potentiometer means for sensing a rotation of the spindle means, an actual value potentiometer means for recording an angular position of the winding means, and an electronic regulating means for comparing values from both potentiometer means and adjusting the winding body means in accordance with a variation from the set value.

9. A singeing machine according to claim 8, further comprising a pressure sensor means located in the gas mixing chamber means for detecting an actual pressure value, and regulator means for adjusting the pressure in the gas mixing chamber means to a predetermined value by adjusting the gas mixture feed.

10. A singeing machine according to claim 1, further comprising a material web guide means including two edge sensor means for scanning edges of the web, and an adjusting means for shifting the sealing strip means along the mixture feed slot means in dependence upon a position sensed by the edge sensor means.

11. A singeing machine according to claim 10, further comprising spindle means for adjusting the edge sensor means, winding means for enabling a winding of outer ends of the flexible sealing strip means for adjustment of inner ends of the sealing strip means, said adjusting means being adapted to rotate the winding means as a function of an amount of spindle rotation, and wherein guide tube means are provided for guiding the sealing strip means to ends of the burner means.

12. A singeing machine according to claim 11, further comprising a set value potentiometer means for sensing a rotation of the spindle means, an actual value potentiometer means for recording an angular position of the winding means, and an electronic regulating means for comparing values from both potentiometer means and adjusting the winding body means in accordance with a variation from the set value.

13. A singeing machine according to claim 1, further comprising a pressure sensor means located in the gas mixing chamber means for detecting an actual pressure value, and regulator means for adjusting the pressure in the gas mixing chamber means to a predetermined value by adjusting the gas mixture feed.

* * * * *